US012576478B2

(12) United States Patent
Kinoshita et al.

(10) Patent No.: US 12,576,478 B2
(45) Date of Patent: Mar. 17, 2026

(54) INORGANIC MEMBER, AND METHOD FOR MANUFACTURING INORGANIC MEMBER

(71) Applicant: NIPPON ELECTRIC GLASS CO., LTD., Otsu (JP)

(72) Inventors: Takumi Kinoshita, Otsu (JP); Naoki Fujita, Otsu (JP)

(73) Assignee: NIPPON ELECTRIC GLASS CO., LTD., Otsu (JP)

( * ) Notice: Subject to any disclaimer, the term of this patent is extended or adjusted under 35 U.S.C. 154(b) by 213 days.

(21) Appl. No.: 18/266,089

(22) PCT Filed: Dec. 10, 2021

(86) PCT No.: PCT/JP2021/045519
§ 371 (c)(1),
(2) Date: Jun. 8, 2023

(87) PCT Pub. No.: WO2022/131154
PCT Pub. Date: Jun. 23, 2022

(65) Prior Publication Data

US 2024/0042576 A1 Feb. 8, 2024

(30) Foreign Application Priority Data

Dec. 17, 2020 (JP) ..... 2020-209600

(51) Int. Cl.
*B24C 1/06* (2006.01)

(52) U.S. Cl.
CPC ..... *B24C 1/06* (2013.01); *Y10T 428/24355* (2015.01)

(58) Field of Classification Search
CPC ..... Y10T 428/24355
See application file for complete search history.

(56) References Cited

U.S. PATENT DOCUMENTS

2015/0315085 A1 11/2015 Berner et al.
2018/0088399 A1* 3/2018 Fukushi ..... C03B 23/0357
2021/0114924 A1 4/2021 Inamoto et al.

FOREIGN PATENT DOCUMENTS

JP H06330363 A 11/1994
JP 2008095777 A 4/2008
JP 2008156160 A * 7/2008
(Continued)

OTHER PUBLICATIONS

[NPL-1] Yamanoguchi (JP 2008-156160 A); Jul. 10, 2008 (European Patent Office machine translation to English). (Year: 2008).*
(Continued)

*Primary Examiner* — Donald M Flores, Jr.
(74) *Attorney, Agent, or Firm* — CANTOR COLBURN LLP

(57) ABSTRACT

Provided are an inorganic member and a method for manufacturing an inorganic member. The inorganic member is configured so that a fine irregularities can be formed on the surface thereof with a simple procedure, and by controlling the shape of the irregularities, realize excellent durability and low wettability with respect to water without forming (depositing) an organic fluorine-based coating film. At least a part of a main surface (surface), in which a skewness of the fine irregularities is −0.1 or less. The fine irregularities are formed by performing the wet blast treatment.

13 Claims, 3 Drawing Sheets

(56) References Cited

FOREIGN PATENT DOCUMENTS

| | | | | |
|---|---|---|---|---|
| JP | 2013033136 | A | 2/2013 | |
| JP | 2014069999 | A | 4/2014 | |
| JP | 2014201445 | A | 10/2014 | |
| JP | 2016508971 | A | 3/2016 | |
| WO | WO-2020009081 | A1 * | 1/2020 | ..... B24C 3/32 |
| WO | 2020045668 | A1 | 3/2020 | |

OTHER PUBLICATIONS

[NPL-2] Inamoto et al. (WO 2020/009081 A1); Jan. 9, 2020 (EPO machine translation to English). (Year: 2020).*
International Search Report for International Application No. PCT/JP2021/045519; Mailing Date, Mar. 8, 2022.
CNIPA First Office Action for corresponding CN Application No. 202180083340.3; Issued Jun. 13, 2025.

* cited by examiner

INORGANIC MEMBER, AND METHOD FOR MANUFACTURING INORGANIC MEMBER

CROSS REFERENCE TO RELATED APPLICATIONS

This is the U.S. national stage of application No. PCT/JP2021/045519, filed on Dec. 10, 2021. Priority under 35 U.S.C. § 119(a) and 35 U.S.C. § 365(b) is claimed from Japanese Application No. 2020-209600, filed Dec. 17, 2020, the disclosure of which is also incorporated herein by reference.

TECHNICAL FIELD

The present invention relates to an inorganic member, and a method for manufacturing the inorganic member.

BACKGROUND ART

Realizing a window panel having low wettability with respect to water (i.e., difficult to get wet) in automobiles, railway vehicles, ships, aircraft, and the like, for example, enables mechanisms such as wipers to be omitted, and since a reduction in manufacturing costs can be expected due to a reduction in a number of components, a shortened manufacturing process, and the like, demand has been increasing in recent years for an inorganic member as a window panel member having lower wettability with respect to water.

In addition, studies to realize inorganic members having lower wettability with respect to water as inorganic members used for ophthalmic lenses and lenses of imaging devices have conventionally progressed.

Incidentally, a method for forming (depositing) a coating film or the like on a surface of a solid or forming irregularities on a surface of a solid to vary the surface energy of the surface, for example, is generally performed as a method for controlling wettability of the surface of the solid.

Here, when irregularities are formed on the surface of the solid, a tendency for wettability of the surface with respect to water differs significantly depending on whether the nature of the solid is hydrophilic or hydrophobic.

That is, it has been proved by the Wenzel model that in a case of a hydrophilic solid, hydrophilicity is improved by forming irregularities on the surface of the solid, and thus, wettability of the surface with respect to water is increased (i.e., easier to get wet), while on the other hand, in a case of a hydrophobic solid, hydrophobicity is improved by forming irregularities on the surface of the solid, and thus, wettability of the surface with respect to water is reduced (i.e., more difficult to get wet).

Consequently, the surface of the inorganic member is hydrophilic, and when irregularities are formed on a surface thereof, hydrophilicity is improved, thus wettability of the surface with respect to water is increased (easier to get wet).

In view of the above, a technique of, for example, forming (depositing) a coating film made of an organic fluorine compound or the like on the surface of the inorganic member has been disclosed in Patent Literature 1 as a technique for realizing a surface of an inorganic member having lower wettability with respect to water (more difficult to get wet).

However, since the coating film formed (deposited) on the surface of such an inorganic member is extremely thin and the coating film may be worn down or peeled off by abrasion such as rubbing, it is difficult to maintain low wettability with respect to water over a long period of time.

Accordingly, a technique of, for example, forming irregularities with a nanopillar structure having a high aspect ratio on the surface of the inorganic member has been disclosed in Patent Literature 2 as a technique for realizing the surface of the inorganic member having lower wettability with respect to water (more difficult to get wet) by forming fine irregularities instead of forming (depositing) a coating film, such as is described above.

CITATIONS LIST

Patent Literature

Patent Literature 1: JP-A H06-330363 Gazette
Patent Literature 2: WO 2020/045668 A Gazette

SUMMARY OF INVENTION

Technical Problems

However, even with the nanopillar structure having a high aspect ratio in Patent Literature 2, there is a possibility that the nanopillar structure is damaged by abrasion such as rubbing, making it difficult to maintain low wettability with respect to water.

In addition, in order to form such a complicated and fine nanopillar structure, it is necessary to undergo a plurality of steps, thus complicating the manufacturing process and increasing manufacturing costs.

The present invention has been made in view of the current problems, and provides an inorganic member and a method for manufacturing the inorganic member, in which it is possible to form fine irregularities on a surface of the inorganic member by a simple method, and by controlling a shape of the irregularities, realize excellent durability and low wettability with respect to water without forming (depositing) an organic fluorine-based coating film.

Solutions to Problems

The problems to be solved by the present invention are as the above, and a means for solving the problems is described below.

That is, an inorganic member according to the present invention is characterized by having fine irregularities on at least a part of a surface, in which a skewness Ssk of the fine irregularities is −0.1 or less.

As long as the inorganic member has such a configuration, the fine irregularities formed on the surface have high rigidity and excellent durability, and further, can easily be formed by, for example, shot blasting or the like.

In addition, when compared with a smooth plane not having fine irregularities, it is possible to increase a contact angle of water droplets adhering to the surface of the inorganic member, thereby enabling the realization of lower wettability with respect to water.

In addition, it is preferable that the inorganic member according to the present invention is made of glass.

Such a configuration makes it possible to obtain an inorganic member having high translucency and excellent processability.

In addition, in the inorganic member according to the present invention, it is preferable that a mean width RSm of roughness profile elements of the fine irregularities is 30 nm or more and 750 nm or less.

Such a configuration makes it possible to more easily form the fine irregularities on the surface of the inorganic member, thereby enabling the prevention of a decrease in the contact angle of the water droplets adhering to the surface of the inorganic member.

In addition, in the inorganic member according to the present invention, it is preferable that a ratio (Rc/RSm) of a mean height Rc of roughness profile elements to the mean width RSm of roughness profile elements of the fine irregularities is 0.02 or more and 1.00 or less.

Such a configuration makes it possible to improve durability of the fine irregularities formed on the surface of the inorganic member, thereby enabling the prevention of a decrease in the contact angle of the water droplets adhering to the surface over a long period of time.

In addition, in the inorganic member according to the present invention, it is preferable that an arithmetical mean height Sa of the fine irregularities is 1 nm or more and 100 nm or less.

When compared with a smooth plane not having fine irregularities, such a configuration makes it possible to more reliably increase the contact angle of the water droplets adhering to the surface of the inorganic member, thereby enabling the realization of lower wettability with respect to water.

In addition, scattering of light due to an uneven shape of the fine irregularities can be minimized, thereby enabling transparency of the surface of the inorganic member on which the fine irregularities are formed to be more reliably ensured.

In addition, in the inorganic member according to the present invention, it is preferable that a maximum height Sz of the fine irregularities is 30 nm or more and 500 nm or less.

When compared with a smooth plane not having fine irregularities, such a configuration makes it possible to further reliably increase the contact angle of the water droplets adhering to the surface of the inorganic member, thereby enabling the realization of lower wettability with respect to water.

In addition, scattering of light due to the uneven shape of the fine irregularities can be further reliably minimized, thereby enabling transparency of the surface of the inorganic member on which the fine irregularities are formed to be more reliably ensured.

Further, the inorganic member according to the present invention may be characterized by having the fine irregularities on at least a part of the surface, and the ratio (Rc/RSm) of the mean height Rc of roughness profile elements to the mean width RSm of roughness profile elements of the fine irregularities may be 0.03 or more and 1.00 or less.

As long as the inorganic member has such a configuration, it is at least possible to improve durability of the fine irregularities formed on the surface of the inorganic member, thereby enabling the prevention of a decrease in the contact angle of the water droplets adhering to the surface over a long period of time.

Also, a method for manufacturing the inorganic member according to the present invention is a method for manufacturing any one of the above-described inorganic members, characterized by performing a wet blast treatment on at least a part of the surface of the inorganic member to form the fine irregularities.

According to the manufacturing method having such a configuration, it is possible to obtain the inorganic member having the fine irregularities formed on the surface, in which, when compared with a smooth plane not having the fine irregularities, it is possible to increase the contact angle of the water droplets adhering to the surface and realize lower wettability with respect to water.

Advantageous Effects of Invention

The present invention has the following effects.

That is, according to the inorganic member and the method for manufacturing the inorganic member of the present invention, it is possible to form fine irregularities on the surface of the inorganic member by a simple method, and by controlling the shape of the irregularities, realize excellent durability and low wettability with respect to water without forming (depositing) an organic fluorine-based coating film.

BRIEF DESCRIPTION OF DRAWINGS

FIG. 2A to FIG. 2C are diagrams for describing various parameters representing a surface roughness of fine irregularities formed on the inorganic member, in which FIG. 2A is a diagram for describing a skewness Ssk, FIG. 2B is a diagram for describing a mean height Rc of roughness profile elements and a mean width RSm of roughness profile elements, and FIG. 2C is a diagram for describing an arithmetical mean height Sa and a maximum height Sz.

DESCRIPTION OF EMBODIMENTS

Next, embodiments of the inorganic member and the method for manufacturing the inorganic member according to the present invention will be described with reference to FIG. 1 to FIG. 3.

[Configuration of Inorganic Member 1]

First, a configuration of an inorganic member 1 of the present embodiment will be described with reference to FIG. 1 to FIG. 3.

The inorganic member 1 is, for example, formed of a rectangular plate-like member and mainly made of glass, ceramic, metal, or the like.

When the inorganic member 1 is comprised of glass, examples of a glass member material include soda-lime glass, alkali-free glass, aluminosilicate glass, borosilicate glass, quartz glass, chalcogenide glass, and the like.

In addition, when the inorganic member 1 is comprised of ceramic, examples of a ceramic member material include sapphire, spinel, and the like.

Further, when the inorganic member 1 is comprised of metal, examples of a metal member material include germanium, silicon, and the like.

Note that it is preferable that the inorganic member 1 is comprised of glass from the viewpoint of high translucency and excellent processability.

In addition, a shape of the inorganic member 1 is not limited to the present embodiment and may be any shape, for example, a flat plate shape having a circular or polygonal contour, a shape in which a flat plate shape is completely curved, a spherical or aspherical lens shape, or the like.

Further, it is preferable that the inorganic member 1 has translucency in at least a part of a wavelength region between the ultraviolet region and the infrared region.

Figure 1:
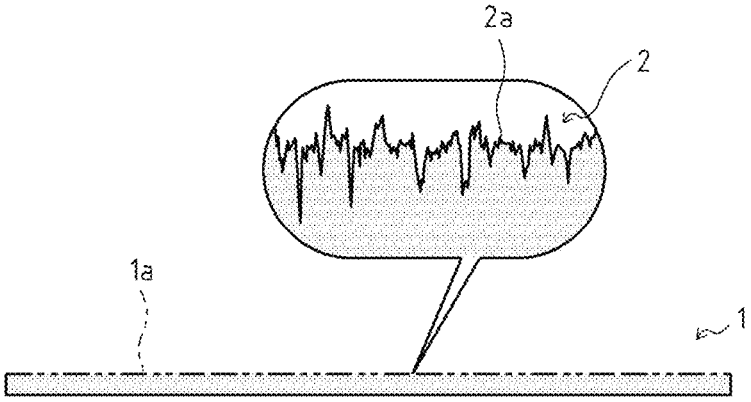
FIG. 1 is a side cross-sectional view showing a configuration of an inorganic member according to one embodiment of the present invention.

As shown in FIG. 1, fine irregularities 2 are formed on one surface (in the present embodiment, a main surface 1*a*) of the inorganic member 1.

The fine irregularities 2 are provided on the surface of the inorganic member 1 mainly for the purpose of lowering the wettability of the inorganic member 1 with respect to water (i.e., making it more difficult to get wet).

Consequently, the fine irregularities 2 may be formed on at least a part of a region of the main surface 1*a* requiring low wettability with respect to water in accordance with a final usage state of the inorganic member 1, and in the present embodiment, they are formed on the entire main surface 1*a*.

The fine irregularities 2 formed on the main surface 1*a* of the inorganic member 1 have a shape configured based on the various surface parameters (skewness Ssk, mean width RSm of roughness profile elements, ratio (Rc/RSm) of mean height Rc of roughness profile elements to mean width RSm of roughness profile elements, arithmetical mean height Sa, and maximum height Sz) shown below.

That is, the fine irregularities 2 are configured such that the skewness Ssk is −0.1 or less (Ssk≤−0.1), the mean width RSm of roughness profile elements is 30 nm or more and 750 nm or less (30 nm≤RSm≤750 nm), the ratio (Rc/RSm) of the mean height Rc of roughness profile elements to the mean width RSm of roughness profile elements is 0.02 or more and 1.00 or less (0.02≤(Rc/RSm)≤1.00), the arithmetical mean height Sa is 1 nm or more and 100 nm or less (1 nm≤Sa≤100 nm), and further, the maximum height Sz is 30 nm or more and 500 nm or less (30 nm≤Sz≤500 nm).

Note that the configuration of the fine irregularities 2 is not limited to the present embodiment, and as long as at least the skewness Ssk is within the range of the above configuration, other parameters, that is, the mean width RSm of roughness profile elements, the ratio (Rc/RSm) of the mean height Rc of roughness profile elements to the a mean width RSm of roughness profile elements, the arithmetical mean height Sa, and/or the maximum height Sz may be outside the ranges of the above configurations.

Alternatively, in the configuration of the fine irregularities 2, as long as at least the ratio (Rc/RSm) of the mean height Rc of roughness profile elements to the mean width RSm of roughness profile elements is within the range of the above configuration, the other parameters, that is, the skewness Ssk, the mean width RSm of roughness profile elements, the arithmetical mean height Sa, and/or the maximum height Sz may be outside the ranges of the above configurations.

"Skewness Ssk" is a parameter defined by ISO25178 and represents a symmetry of peak portions and valley portions of the uneven shape constituting the main surface 1*a* of the inorganic member 1 when an average plane (the two-dot chain line in FIG. 2A) is at the center.

Figure 2A:
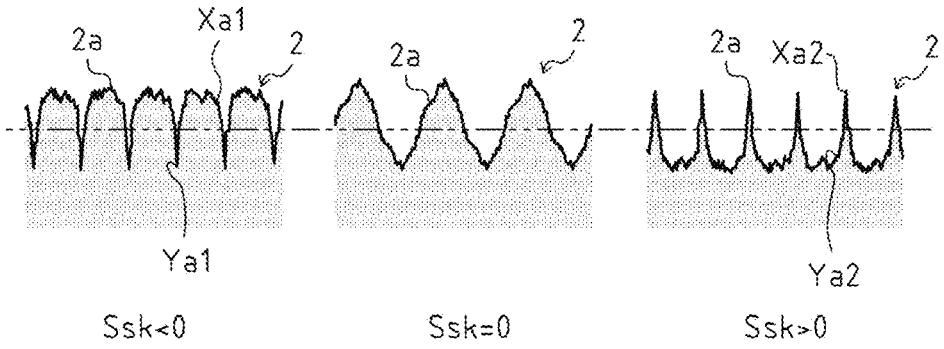

Specifically, as shown in FIG. 2A, when the skewness Ssk is a negative value (Ssk<0), a histogram of a height distribution of the fine irregularities 2 constituting the surface has a shape that skews upward with respect to the average plane.

On the other hand, when the skewness Ssk is a positive value (Ssk>0), the histogram of the height distribution of the fine irregularities 2 constituting the surface has a shape that skews downward with respect to the average plane.

And, when the skewness Ssk is 0 (strictly speaking, a value approximating 0) (Ssk=0), the histogram of the height distribution of the fine irregularities 2 constituting the surface has a shape that is distributed symmetrically with respect to the average plane.

In the present embodiment, as described above, the skewness Ssk of the fine irregularities 2 is −0.1 or less, and the present embodiment has a configuration provided with the fine irregularities 2 (see FIG. 3) in which a plurality of valley portions Ya, Ya . . . having narrower intervals than a plurality of peak portions Xa, Xa . . . are provided respectively among the peak portions Xa on the main surface 1*a* of the inorganic member 1.

Figure 3:
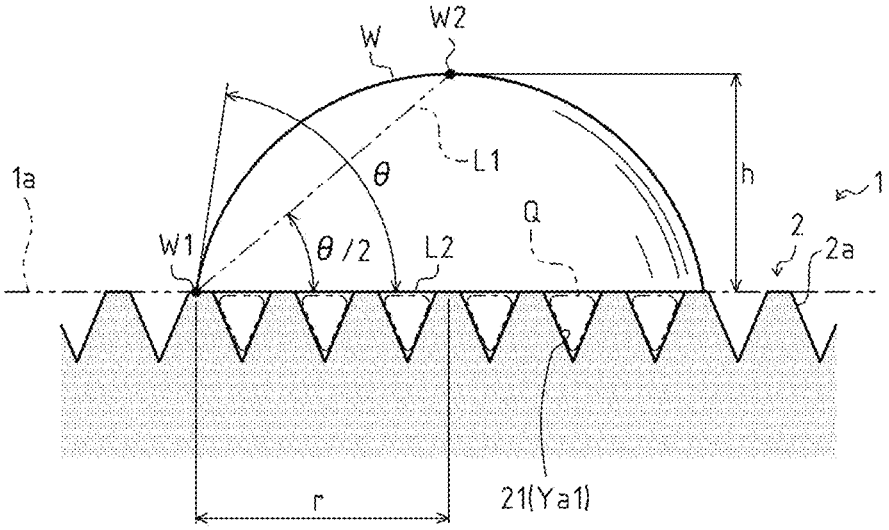
FIG. 3 is an enlarged side cross-sectional view schematically showing a state in which water droplets are adhered to the fine irregularities formed on the inorganic member.

As a result, as shown in FIG. 3, when water droplets W adhere to the main surface 1*a* of the inorganic member 1, air layers Q, Q . . . are likely to be formed in a plurality of concave portions 21, 21 . . . occluded by the water droplets W and a contact angle θ of the water droplets W increases, thereby reducing wettability of the main surface 1*a* of the inorganic member 1 with respect to water (i.e., it is more difficult to get wet).

Note that in the present embodiment, an upper limit value of the skewness Ssk is −0.1, but is preferably −0.2, and more preferably −0.3.

In addition, a lower limit value of the skewness Ssk is not particularly limited, and is substantially −10 or more, but is preferably −5 or more, more preferably −3 or more, further more preferably −2 or more, and particularly preferably −1.5 or more since it is limited by technical factors such as a reduction in strength of the inorganic member 1 or a method for forming the fine irregularities 2 (for example, the later-described wet blast treatment).

"Mean width RSm of roughness profile elements" is a parameter defined by JISB0601:2013 and represents an average pitch between concave portions and convex portions adjacent to one another in an uneven shape constituting a roughness profile 2*a*.

Figure 2B:
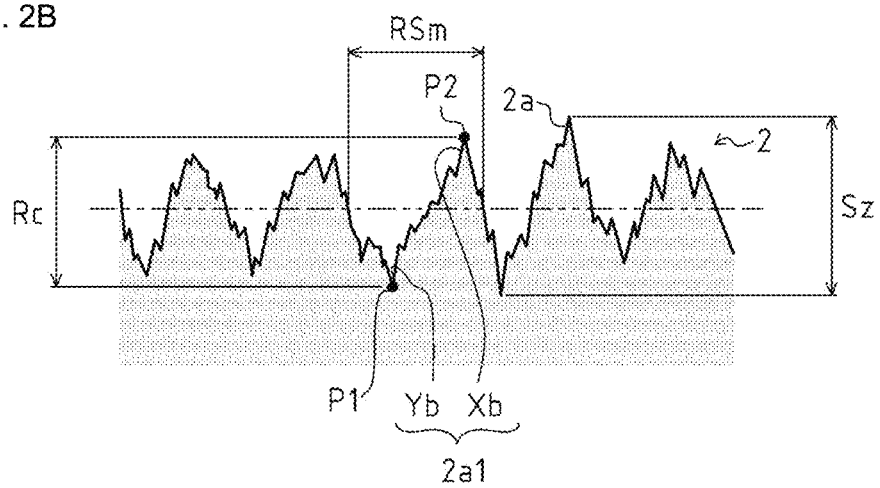

Specifically, as shown in FIG. 2B, the roughness profile 2*a* is formed by a plurality of continuous profiles 2*a*1, 2*a*1 . . . and each of the profile 2*a*1 is comprised of a peak portion Xb and a valley portion Yb adjacent to one another.

Note that the peak portion Xb and the valley portion Yb above each have a plurality of fine irregularities, and when these fine irregularities do not reach a predetermined threshold (for example, 10% of a maximum height (or a maximum depth) of the peak portion Xb (or the valley portion Yb)), they are regarded as noise and recognized as a part of the peak portion Xb or the valley portion Yb.

And the mean width RSm of roughness profile elements is represented by an average length of the plurality of profiles 2*a*1, 2*a*1 . . . (RSm=(RSm1+RSm2+ . . . RSmn)/n).

In the present embodiment, as described above, the mean width RSm of roughness profile elements of the fine irregularities 2 is 30 nm or more and 750 nm or less.

Here, it is preferable that a value of the mean width RSm of roughness profile elements is as small as possible so that the uneven shape of the fine irregularities 2 formed on the main surface 1*a* of the inorganic member 1 becomes denser, however since the value is limited by technical factors of the method for forming the fine irregularities 2 (for example, the later-described wet blast treatment), it is substantially nm, which is the lower limit value above.

Note that in the present embodiment, the lower limit value of the mean width RSm of roughness profile elements is 30 nm, but is preferably 60 nm, more preferably nm, further preferably 120 nm, and particularly preferably 150 nm.

In addition, in the present embodiment, the upper limit value of the mean width RSm of roughness profile elements is 750 nm, but is preferably 700 nm, more preferably 600 nm, further preferably 500 nm, and particularly preferably 400 nm.

Note that when the mean width RSm of roughness profile elements exceeds the upper limit value of 750 nm, liquid is likely to enter the concave portions 21 (see FIG. 3) of the fine irregularities 2.

As a result, in FIG. 3, when the water droplets W adhere to the main surface 1*a* of the inorganic member 1, it is difficult to maintain the air layers Q, Q . . . in the plurality of concave portions 21, 21 . . . occluded by the water droplets W and the contact angle θ of the water droplets W decreases, thus wettability of the main surface 1*a* of the inorganic member 1 with respect to water becomes higher (i.e., easier to get wet), therefore it is not preferable.

"Ratio (Rc/RSm) of the mean height Rc of roughness profile elements to the mean width RSm of roughness profile elements" refers to a virtual aspect ratio of the fine irregularities 2.

In addition, "mean height Rc of roughness profile elements" above is a parameter defined by JISB0601:2013 and represents an average separation distance between a lower end of the concave portion and an upper end of the convex portion adjacent to one another in the uneven shape constituting the roughness profile 2*a*.

Specifically, as shown in FIG. 2B, the mean height Rc of elements is represented by an average value of the separation distance between a lower end P1 of the valley portion Yb and an upper end P2 of the peak portion Xb in the each of the profiles 2*a*1 above (Rc=(Rc1+Rc2+ . . . Rcn)/n).

In the present embodiment, as described above, the ratio (Rc/RSm) of the mean height Rc of roughness profile elements to the mean width RSm of roughness profile elements of the fine irregularities 2 is 0.02 or more and 1.00 or less.

Here, a value of the above ratio (Rc/RSm) is preferably as large as possible, and in the present embodiment, a lower limit value thereof is 0.02, but is preferably 0.03, more preferably 0.05, further preferably 0.07, and particularly preferably 0.09.

When the value of the above ratio (Rc/RSm) does not reach the lower limit value of 0.02, liquid is likely to enter the concave portions 21 (see FIG. 3) of the fine irregularities 2.

As a result, similarly to the above-described case where the mean width RSm of elements exceeds the upper limit value of 750 nm, wettability of the main surface 1*a* of the inorganic member 1 with respect to water becomes higher (i.e., easier to get wet), therefore it is not preferable.

On the other hand, when the value of the above ratio (Rc/RSm) exceeds the upper limit value of 1.00, not only is scattering of light due to the uneven shape of the fine irregularities 2 likely to occur and transparency of the main surface 1*a* of the inorganic member 1 is impaired, but also, damage due to abrasion or the like is likely to occur and durability of the fine irregularities 2 is reduced, therefore it is not preferable.

Note that in the present embodiment, the upper limit value of the ratio (Rc/RSm) value is 1.00, but is preferably 0.50, more preferably 0.30, further preferably 0.20, and particularly preferably 0.18.

"Arithmetical mean height Sa" is a parameter defined by ISO25178, and is a parameter obtained by extending elements of the roughness profile 2*a*, which form a line, in a plane.

Figure 2C:
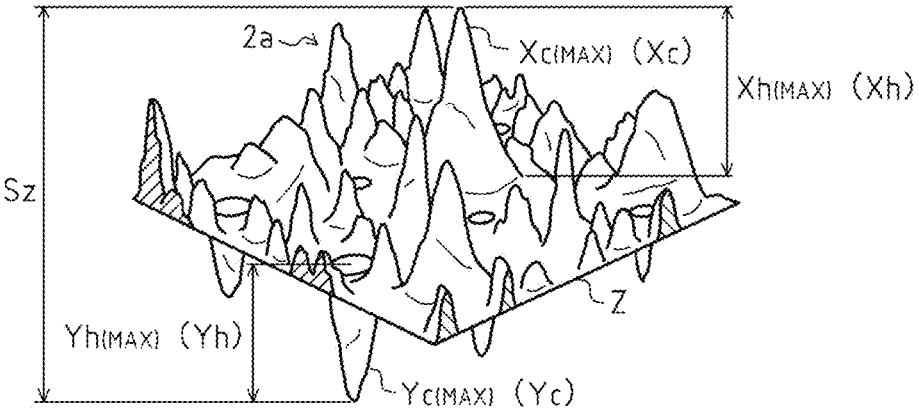

Specifically, as shown in FIG. 2C, the arithmetical mean height Sa represents an average of absolute values of separation distances (for example, a height Xh to a vertex of a peak portion Xc and a depth Yh to a vertex of a valley portion Yc) between each point of the uneven shape constituting the fine irregularities 2 with respect to an average plane Z of the main surface 1*a* of the inorganic member 1 (Sa=((Xh1+Xh2+ . . . +Xhn)+(−1)(Yh1+Yh2+ . . . +Yhn))/2n).

Here, in FIG. 3, in the case that the value of the arithmetical mean height Sa becomes too small, when the water droplets W adhere to the main surface 1*a* of the inorganic member 1, it is difficult to maintain the air layers Q, Q . . . in the plurality of concave portions 21, 21 . . . occluded by the water droplets W and the contact angle θ of the water droplets W decreases, thus wettability of the main surface 1*a* of the inorganic member 1 with respect to water becomes higher (i.e., easier to get wet), therefore it is not preferable.

On the other hand, when the value of the arithmetical mean height Sa becomes too large, scattering of light due to the uneven shape of the fine irregularities 2 is likely to occur and transparency of the main surface 1*a* of the inorganic member 1 is impaired, therefore it is not preferable.

In view of the above, in the present embodiment, as described above, the arithmetical mean height Sa of the fine irregularities 2 is 1 nm or more and 100 nm or less.

Note that a lower limit value of the arithmetical mean height Sa is 1 nm, but is preferably 2 nm, more preferably 3 nm, further preferably 4 nm, and particularly preferably 5 nm.

In addition, an upper limit value of the arithmetical mean height Sa is 100 nm, but is preferably 80 nm, more preferably 60 nm, further preferably 40 nm, and particularly preferably 30 nm.

Same as the above-described arithmetical mean height Sa, "maximum height Sz" is a parameter defined by ISO25178 and is a parameter obtained by extending the elements of the roughness profile 2*a*, which form a line, in a plane.

Specifically, as shown in FIG. 2C, the maximum height Sz represents a sum of absolute values of maximum separation distances (for example, a height Xh (MAX) to a vertex of a maximum peak portion Xc (MAX) and a depth Yh (MAX) to a vertex of a valley portion Yc (MAX)) between each point of the uneven shape constituting the fine irregularities 2 with respect to the average plane Z of the main surface 1*a* of the inorganic member 1 (Sz=(Xh(MAX)+(−1)(Yh(MAX)).

Here, in FIG. 3, in the case that the value of the maximum height Sz becomes too small, when the water droplets W adhere to the main surface 1*a* of the inorganic member 1, it is difficult to maintain the air layers Q, Q . . . in the plurality of concave portions 21, 21 . . . occluded by the water droplets W and the contact angle θ of the water droplets W decreases, thus wettability of the main surface 1*a* of the inorganic member 1 with respect to water becomes higher (i.e., easier to get wet), therefore it is not preferable.

On the other hand, when the value of the maximum height Sz becomes too large, not only is scattering of light due to the uneven shape of the fine irregularities 2 likely to occur and transparency of the main surface 1*a* of the inorganic member 1 is impaired, but also, damage due to abrasion or the like is likely to occur and durability of the fine irregularities 2 is reduced, therefore it is not preferable.

In view of the above, in the present embodiment, as described above, the maximum height Sz of the fine irregularities 2 is 30 nm or more and 500 nm or less.

Note that a lower limit value of the maximum height Sz is 30 nm, but is preferably 40 nm, more preferably 50 nm, further preferably 80 nm, and particularly preferably 110 nm.

The upper limit value of a maximum height Sz is 500 nm, but is preferably 450 nm, more preferably 400 nm, further preferably 350 nm, and particularly preferably 330 nm.

Incidentally, the contact angle θ of the main surface 1*a* of the inorganic member 1 on which the fine irregularities 2 are formed is preferably 60° or more, more preferably 70° or more, further preferably 75° or more, and particularly preferably 80° or more.

Note that an upper limit value of the contact angle θ is not particularly limited, and may be, for example, 180°.

A water-repellent film for lowering a surface energy of the main surface 1*a* can be formed (deposited) on the main surface 1*a* of the inorganic member 1 on which the fine irregularities 2 are formed and having a shape such as the above for the purpose of further lowering the wettability with respect to water (i.e., making it more difficult to get wet).

The water-repellent film can be formed (deposited) by bonding a silane compound or the like containing an alkyl group or a fluoroalkyl group to the surface (main surface 1*a*) of the inorganic member 1.

Note that when the water-repellent film is formed (deposited) on the main surface 1*a* of the inorganic member 1, fine irregularities (fine irregularities having a shape similar to the above-described fine irregularities 2) are formed in advance on the main surface 1*a* such that the uneven shape of the surface of the water-repellent film after forming becomes the shape configured by the above-described various parameters (the skewness Ssk, the mean width RSm of roughness profile elements, the ratio (Rc/RSm) of the mean height Rc of roughness profile elements to the mean width RSm of roughness profile elements, the arithmetical mean height Sa, and the maximum height Sz).

The inorganic member 1 may be provided with an antireflection film, a reflection film, a half mirror film, or the like.

A low refractive index film having a refractive index lower than that of a glass substrate, or a dielectric multilayer film in which a low refractive index layer having a relatively low refractive index and a high refractive index layer having a relatively high refractive index are alternately stacked, for example, is used as the antireflection film.

A dielectric multilayer film in which a low refractive index layer having a relatively low refractive index and a high refractive index layer having a relatively high refractive index are alternately stacked, for example, is used as the reflection film and the half mirror film.

The antireflection film, the reflection film, and the half mirror film may be formed by, for example, a sputtering method or a CVD method.

[Method for Manufacturing Inorganic Member 1]

Next, a method for manufacturing the inorganic member 1 will be described with reference to FIG. 1.

The fine irregularities 2 formed on at least a part of the surface (main surface 1*a*) of the inorganic member 1 are formed by performing a wet blast treatment or the like on the main surface 1*a*.

The wet blast treatment is a treatment in which abrasive grains comprised of solid particles such as alumina and a liquid such as water are uniformly stirred to form a slurry, then the slurry is sprayed at a high speed from a spray nozzle on a workpiece made of the inorganic member 1 using compressed air to form fine irregularities on the workpiece.

In the wet blast treatment, when the slurry sprayed at a high speed collides with the workpiece, the abrasive grains in the slurry scrape, knock, or rub the surface of the workpiece to form fine irregularities on the surface of the workpiece.

In this case, since the abrasive grains sprayed on the workpiece and fragments of the workpiece scraped by the abrasive grains are washed away by the liquid sprayed on the workpiece, particles remaining on the workpiece are reduced.

A surface roughness (the skewness Ssk, the mean width RSm of roughness profile elements, the ratio (Rc/RSm) of the mean height Rc of roughness profile elements to the mean width RSm of roughness profile elements, the arithmetical mean height Sa, and the maximum height Sz) of the fine irregularities 2 formed on the main surface 1*a* of the workpiece (inorganic member 1) by the wet blast treatment may be mainly adjusted by a grain size distribution of the abrasive grains included in the slurry, an injection pressure when the slurry is sprayed on the workpiece, and a treatment speed of the movement of the nozzle.

In the wet blast treatment, when the slurry is sprayed on the workpiece, since the liquid carries the abrasive grains to the workpiece, finer abrasive grains can be used when compared to a dry blast treatment, and an impact when the abrasive grains collide with the workpiece is reduced, thereby enabling more precise machining.

Thus, by performing the wet blast treatment on the workpiece (inorganic member 1), it is possible to easily form an uneven shape of an appropriate size on the main surface 1*a* of the inorganic member 1 and increase the contact angle θ of the water droplets W adhering to the main surface 1*a* without impairing transparency of the inorganic member 1, thus lowering wettability of the main surface 1*a* of the inorganic member 1 with respect to water (i.e., making it more difficult to get wet).

Note that while in the dry blast treatment, processing heat is generated in the workpiece due to abrasion when the sprayed abrasive grains collide with the workpiece, in the wet blast treatment, since the liquid constantly cools the surface of the workpiece during treatment, the workpiece is not heated by the blast treatment.

In addition, by performing the dry blast treatment, it is also possible to form the fine irregularities 2 on the main surface 1*a* of the inorganic member 1, however in the dry blast treatment, the impact when the abrasive grains collide with the main surface 1*a* of the inorganic member 1 is so large that the surface roughness of the main surface 1*a* on which the fine irregularities 2 are formed is likely to increase and transparency of the inorganic member 1 is likely to be impaired.

Incidentally, in addition to the wet blast treatment, a chemical etching treatment, a sol gel method, a nanoimprint method, or the like can be used to form the fine irregularities 2 on the main surface 1*a* of the inorganic member 1.

Here, the chemical etching treatment is a treatment of chemically etching the main surface 1*a* of the inorganic member 1 with hydrofluoric acid (HF) gas, an acid such as hydrofluoric acid, hydrochloric acid, or sulfuric acid, an alkaline aqueous solution such as sodium hydroxide, or the like.

EXAMPLES

Next, the inorganic member on which the fine irregularities are formed according to the present invention will be described in detail using the examples and the comparative examples.

Note that the configuration of the inorganic member according to the present invention is not limited to the examples shown below.

[Preparation of Samples]

First, samples 1 to 14 and 20 to 22 were each prepared as examples of the inorganic member according to the present invention, and samples 15 to 19 were each prepared as comparative examples to these examples.

Note that in respect of a material of samples 1, 2, 7 to 15, and 18 to 20, a non-alkali glass (manufactured by Nippon Electric Glass Co., Ltd., product name: OA-10G) having a rectangular plate shape with a thickness of 0.5 mm was used as "glass 1".

In addition, in respect of a material of samples 3, 4, 16, 21, and 22, an aluminosilicate glass (manufactured by Nippon Electric Glass Co., Ltd., product name: T2X-1) having a rectangular plate shape with a thickness of 0.5 mm was used as "glass 2".

Further, in respect of a material of samples 5, 6, and 17, a borosilicate glass (manufactured by Nippon Electric Glass Co., Ltd., product name: BDA) having a rectangular plate shape with a thickness of 0.5 mm was used as "glass 3".

The wet blast treatment was performed on the inorganic members of samples 1 to 14 and 20 to 22, which are the examples, to form fine irregularities on one main surface.

Specifically, a slurry was prepared as a polishing agent by uniformly stirring abrasive grains made of alumina ($Al_2O_3$) with water, and the entire one main surface of each inorganic member was subjected to a wet blast in which a nozzle was moved while scanning at a predetermined treatment speed and the prepared slurry was sprayed from the nozzle using air at a predetermined treatment pressure.

Here, #8000 polygonal abrasive grains were used for the inorganic members of samples 1 to 12 and 20, #4000 polygonal abrasive grains were used for the inorganic members of samples 13, 14 and 21, and #2000 polygonal abrasive grains were used for the inorganic member of sample 22.

In addition, the treatment pressure of the air in the nozzle was 0.22 MPa for the inorganic members of samples 1 to 6, 0.15 MPa for the inorganic members of samples 7 and 8, 0.13 MPa for the inorganic members of samples 9 to 12, 0.10 MPa for the inorganic member of sample 13, 0.20 MPa for the inorganic member of sample 14, 0.30 MPa for the inorganic member of sample 20, and 0.25 MPa for the inorganic members of samples 21 and 22.

Further, the above treatment speed of the movement of the nozzle was 10 mm/s for the inorganic members of samples 1, 3, 5, 7, 10, and 20, 5 mm/s for the inorganic members of samples 2, 4, 6, 8, 11, 13, 14, 21, and 22, 20 mm/s for the inorganic member of sample 9, and 1 mm/s for the inorganic member of sample 12.

For the inorganic members of samples 15 to 17 which are comparative examples, treatment was not performed on the one main surface.

That is, the inorganic members of samples 15 to 17 were left untreated without using a polishing agent.

A wet etching treatment using hydrofluoric acid was performed on the inorganic member of sample 18, which is a comparative example, to form fine irregularities on the one main surface.

Specifically, the one main surface of the inorganic member was immersed in a hydrofluoric acid solution (30° C.) adjusted to a concentration of 5 wt % for 2000 seconds to form the fine irregularities.

The inorganic member of sample 19, which is a comparative example, was coated with silica using the sol gel method to form fine irregularities on the one main surface.

Specifically, a liquid containing a silica component was applied by spraying, then the applied liquid containing the silica component was dried to form the fine irregularities made of a silica coating film on the main surface.

Table 1 shows the materials of the inorganic members of samples 1 to 19 shown above, the irregularity formation method for forming the fine irregularities, and the conditions including the polishing agent (abrasive grains), the treatment air pressure, and the treatment speed when performing the wet blast treatment.

TABLE 1

| | | Material | Irregularity formation method | Abrasive grain | Treatment air pressure [Mpa] | Treatment speed [mm/s] |
|---|---|---|---|---|---|---|
| Examples | Sample 1 | Glass 1 | Wet blasting | #8000 $Al_2O_3$ | 0.22 | 10 |
| | Sample 2 | Glass 1 | Wet blasting | #8000 $Al_2O_3$ | 0.22 | 5 |
| | Sample 3 | Glass 2 | Wet blasting | #8000 $Al_2O_3$ | 0.22 | 10 |
| | Sample 4 | Glass 2 | Wet blasting | #8000 $Al_2O_3$ | 0.22 | 5 |
| | Sample 5 | Glass 3 | Wet blasting | #8000 $Al_2O_3$ | 0.22 | 10 |
| | Sample 6 | Glass 3 | Wet blasting | #8000 $Al_2O_3$ | 0.22 | 5 |
| | Sample 7 | Glass 1 | Wet blasting | #8000 $Al_2O_3$ | 0.15 | 10 |
| | Sample 8 | Glass 1 | Wet blasting | #8000 $Al_2O_3$ | 0.15 | 5 |
| | Sample 9 | Glass 1 | Wet blasting | #8000 $Al_2O_3$ | 0.13 | 20 |
| | Sample 10 | Glass 1 | Wet blasting | #8000 $Al_2O_3$ | 0.13 | 10 |
| | Sample 11 | Glass 1 | Wet blasting | #8000 $Al_2O_3$ | 0.13 | 5 |
| | Sample 12 | Glass 1 | Wet blasting | #8000 $Al_2O_3$ | 0.13 | 1 |
| | Sample 13 | Glass 1 | Wet blasting | #4000 $Al_2O_3$ | 0.10 | 5 |
| | Sample 14 | Glass 1 | Wet blasting | #4000 $Al_2O_3$ | 0.20 | 5 |
| | Sample 20 | Glass 1 | Wet blasting | #8000 $Al_2O_3$ | 0.30 | 10 |
| | Sample 21 | Glass 2 | Wet blasting | #4000 $Al_2O_3$ | 0.25 | 5 |
| | Sample 22 | Glass 2 | Wet blasting | #2000 $Al_2O_3$ | 0.25 | 5 |
| Comparative examples | Sample 15 | Glass 1 | — | — | — | — |
| | Sample 16 | Glass 2 | — | — | — | — |
| | Sample 17 | Glass 3 | — | — | — | — |
| | Sample 18 | Glass 1 | Hydrofluoric acid etching | — | — | — |
| | Sample 19 | Glass 1 | Sol gel method | — | — | — |

[Measurement of Contact Angle θ]

Next, in order to confirm wettability with respect to water of the inorganic members of samples 1 to 22, the contact angle θ on each main surface on which the fine irregularities were formed was measured.

In respect of the measurement method for the contact angle θ, the contact angle θ was measured based on a static drop method (so-called θ/2 approximation method) of JISR3257:1999, in which approximately 2 μL of pure water was dropped onto each of the horizontally placed inorganic members with the main surface on which the fine irregularities were formed facing upward, then the water droplets were imaged from right beside with a digital scope (manufactured by Keyence Corporation, product name: VHX-500F).

Specifically, as shown in FIG. 3, each (θ/2) between a virtual straight line L1 connecting an endpoint W1 and a vertex W2 of the water droplets W and a virtual horizontal straight line L2 on the main surface 1*a* of the inorganic member 1 was calculated based on image data of the imaged water droplets W, then the contact angle θ was derived based on the following equation 1.

$$\theta=2\tan-1(h/r) \quad \text{(equation 1)}$$

h: height of the vertex W2 r: radius of the bottom surface of the water droplets W

[Measurement of Surface Roughness]

Next, the surface roughness of the main surface of the inorganic member of each of samples 1 to 22 was measured.

The measurement of the surface roughness was performed on the main surface subjected to the wet blast treatment for samples 1 to 14 and 20 to 22, on one main surface for samples 15 to 17, on the main surface on which the wet etching treatment is performed using hydrofluoric acid for sample 18, and on the main surface provided with the silica coating film for sample 19.

The parameters of the measured surface roughness were the skewness Ssk, the mean width RSm of roughness profile elements, the mean height Rc of roughness profile elements, the arithmetical mean height Sa, and the maximum height Sz of the formed fine irregularities, and these measurements were performed using an atomic force microscope (AFM). Note that the measurement of sample 19 was performed using a laser microscope.

In addition, the ratio (Rc/RSm) of the mean height Rc of roughness profile elements to the mean width RSm of roughness profile elements was derived based on the measured values above.

Note that the atomic force microscope (AFM) used for the measurement was an atomic force microscope manufactured by Bruker Corporation (trade name (SPM unit): Dimension Icon, trade name (Controller unit): Nano Scope V), and measurement was performed based on JISB0601:2013 and ISO25178.

In addition, measurement was performed using a tapping mode, and as for conditions, a scan rate was 1 Hz and a number of acquired pieces of data corresponded to 512×512 with respect to a region with a measurement area of 5 μm×5 μm.

In addition, the laser microscope used for the measurement was a laser microscope manufactured by Keyence Corporation (trade name: VK-X250), and the measurement was performed based on JISB0601:2013 and ISO25178.

In addition, measurement was performed with the following conditions: a cutoff value λc of a high-pass filter λc was 50 μm, a cutoff value λs of a low-pass filter λs was 0.5 μm, and the number of acquired pieces of data was 2048×1536 pixels with respect to a region with a measurement area of about 287 μm×215 μm.

[Measurement Results of Contact Angle θ and Surface Roughness]

The measurement results of the contact angle θ and the surface roughness of samples 1 to 22 will be described.

The measurement results for the contact angle θ are shown in Table 2 below, and the measurement results for the surface roughness are shown in Tables 2 and 3 below.

TABLE 2

| | | Contact angle [°] | Skewness Ssk | Mean length RSm [nm] | Mean height Rc [nm] | Ratio of mean height to mean length Rc/RSm |
|---|---|---|---|---|---|---|
| Examples | Sample 1 | 90 | −0.7 | 224.5 | 27.9 | 0.12 |
| | Sample 2 | 85 | −0.6 | 231.1 | 26.4 | 0.11 |
| | Sample 3 | 87 | −0.4 | 206.1 | 26.6 | 0.13 |
| | Sample 4 | 87 | −0.9 | 197.9 | 25.3 | 0.13 |
| | Sample 5 | 81 | −0.9 | 231.0 | 27.6 | 0.12 |
| | Sample 6 | 81 | −1.0 | 194.0 | 23.8 | 0.12 |
| | Sample 7 | 85 | −1.0 | 220.9 | 16.4 | 0.07 |
| | Sample 8 | 89 | −0.5 | 201.3 | 22.2 | 0.11 |
| | Sample 9 | 82 | −1.6 | 182.3 | 9.8 | 0.05 |
| | Sample 10 | 84 | −1.8 | 158.4 | 11.4 | 0.07 |
| | Sample 11 | 87 | −1.3 | 182.2 | 19.5 | 0.11 |
| | Sample 12 | 85 | −0.6 | 209.6 | 22.2 | 0.11 |
| | Sample 13 | 81 | −1.9 | 234.3 | 17.7 | 0.08 |
| | Sample 14 | 92 | −0.9 | 277.8 | 36.3 | 0.13 |
| | Sample 20 | 93 | −0.6 | 181.5 | 29.0 | 0.16 |
| | Sample 21 | 95 | −0.9 | 306.9 | 42.3 | 0.14 |
| | Sample 22 | 96 | −0.8 | 582.5 | 76.3 | 0.13 |
| Comparative examples | Sample 15 | 33 | 0 | — | — | — |
| | Sample 16 | 14 | 0 | — | — | — |
| | Sample 17 | 34 | 0 | — | — | — |
| | Sample 18 | 15 | 0.1 | 1057.5 | 11.2 | 0.01 |
| | Sample 19 | 50 | 1.0 | 11080 | 240 | 0.02 |

TABLE 3

| | | Arithmetical mean height Sa [nm] | Maximum height Sz [nm] |
|---|---|---|---|
| Examples | Sample 1 | 13.0 | 206 |
| | Sample 2 | 12.8 | 156 |
| | Sample 3 | 13.6 | 227 |
| | Sample 4 | 13.1 | 186 |
| | Sample 5 | 14.2 | 166 |
| | Sample 6 | 13.4 | 199 |
| | Sample 7 | 7.3 | 164 |
| | Sample 8 | 9.8 | 178 |
| | Sample 9 | 3.9 | 184 |
| | Sample 10 | 5.8 | 174 |
| | Sample 11 | 7.2 | 180 |
| | Sample 12 | 8.6 | 117 |
| | Sample 13 | 6.9 | 173 |
| | Sample 14 | 18.3 | 328 |
| | Sample 20 | 17.1 | 225 |
| | Sample 21 | 21.9 | 312 |
| | Sample 22 | 42.3 | 371 |
| Comparative examples | Sample 15 | 0.2 | 2 |
| | Sample 16 | 0.2 | 2 |
| | Sample 17 | 0.2 | 2 |
| | Sample 18 | 3.6 | 42 |
| | Sample 19 | 120 | 2080 |

As shown in Table 2, in the inorganic members of samples 1 to 14 and 20 to 22, which are the examples, the contact angles θ of the main surfaces on which the fine irregularities were formed were as high as 81° to 96°, which showed favorable results indicating low wettability with respect to water (i.e., difficult to get wet).

On the other hand, in the inorganic members of samples 15 to 19, which are the comparative examples, the contact angles θ of the one main surface (the main surface on which the wet etching treatment using hydrofluoric acid was performed for sample 18, and the main surface provided with the silica coating film for sample 19) were 14° to 50°, which were considerably lower values than those in the above-described examples, thus showing poor results indicating high wettability with respect to water (i.e., easy to get wet).

Based on the above results, the measurement results of the surface roughness of the inorganic members of samples 1 to 22 will be examined.

The skewness Ssk was a value within a range of −1.9 to −0.4 inclusive in the inorganic members of samples 1 to 14 and 20 to 22, which are the examples.

On the other hand, in the inorganic members of samples 15 to 17, which are untreated comparative examples, for sample 18 on which the wet etching treatment using hydrofluoric acid was performed, and sample 19 provided with the silica coating film, the skewness Ssk was a value in a range of 0 to 1.0 inclusive, that is, 0 or a positive value.

In addition, the mean width RSm of roughness profile elements was a value in a range of 158.4 nm to 582.5 nm inclusive in the inorganic members of samples 1 to 14 and 20 to 22, which are the examples, and the value of the mean width RSm also tended to increase as the air treatment pressure increased or the treatment speed of the nozzle decreased when the wet blast treatment was performed.

On the other hand, in the inorganic members of sample 18, on which the wet etching treatment using hydrofluoric acid was performed, and sample 19 provided with the silica coating film, the mean width RSm of roughness profile elements were 1057.5 nm and 11080 nm, respectively, which were considerably larger values than those in the above-described examples.

Further, the ratio (Rc/RSm) of the mean height Rc of roughness profile elements to the mean width RSm of roughness profile elements was a value in a range of 0.05 to 0.16 inclusive in the inorganic members of samples 1 to 14 and 20 to 22, which are the examples, and the value of the ratio (Rc/RSm) also tended to increase as the air treatment pressure increased or the treatment speed of the nozzle decreased when the wet blast treatment was performed.

On the other hand, in the inorganic member of sample 18, on which the wet etching treatment using hydrofluoric acid was performed, the ratio (Rc/RSm) of the mean height Rc of roughness profile elements to the mean width RSm of roughness profile elements was 0.01, which was a smaller value than those in the above-described examples.

In addition, in the inorganic member of sample 19 provided with the silica coating film, the ratio (Rc/RSm) of the mean height Rc of roughness profile elements to the mean width RSm of roughness profile elements was 0.02, which was a smaller value than those in the above-described examples.

Also, as shown in Table 3, the arithmetical mean height Sa was a value in a range of 3.9 nm to 42.3 nm inclusive in the inorganic members of samples 1 to 14 and 20 to 22, which are the examples, and the value of the arithmetical mean height Sa also tended to increase as the air treatment pressure increased or the treatment speed of the nozzle decreased when the wet blast treatment was performed.

On the other hand, in the inorganic members of samples 15 to 17, which are the untreated comparative examples, and sample 18, on which the wet etching treatment using hydrofluoric acid was performed, the arithmetical mean height Sa was a value in a range of 0.2 nm to 3.6 nm inclusive, which was a smaller value than those in the above-described examples.

In addition, in the inorganic member of sample 19 provided with the silica coating film, the arithmetical mean height Sa was 120 nm, which was a considerably larger value than those in the above-described examples.

In addition, the maximum height Sz was a value in a range of 117 nm to 371 nm inclusive in the inorganic members of samples 1 to 14 and 20 to 22, which are the examples, and the value of the maximum height Sz also tended to increase as the air treatment pressure increased when the wet blast treatment was performed.

On the other hand, in the inorganic members of samples 15 to 17, which are the untreated comparative examples, and sample 18, on which the wet etching treatment using hydrofluoric acid was performed, the maximum height Sz was a value in a range of 2 nm to 42 nm inclusive, which was a considerably smaller value than those in the above-described examples.

In addition, in the inorganic member of sample 19 provided with the silica coating film, the maximum height Sz was 2080 nm, which was considerably larger than those in the above-described examples.

[Effects]

As described above, the inorganic member 1 of the present embodiment has the fine irregularities 2 on at least a part of the main surface 1*a* (surface), in which the skewness Ssk of the fine irregularities 2 is −0.1 or less.

Thus, in the present embodiment, the skewness Ssk of the formed fine irregularities 2 is a negative value, and the fine irregularities 2 have an uneven shape in which the valley portions Ya, Ya . . . having narrower intervals than the peak portions Xa are present between each peak portion Xa1, as shown in FIG. 2A, thus, the fine irregularities 2 have high rigidity and excellent durability, and further, can be easily formed by, for example, causing particles to collide with the main surface (surface) 1*a* of the inorganic member 1 by shot blasting or the like.

In addition, as shown in FIG. 3, on the main surface (surface) 1*a* of the inorganic member 1 on which the fine irregularities 2 are formed, since the air layer Q is maintained in the concave portions 21 of the fine irregularities 2, when compared with a smooth plane not having the fine irregularities 2, it is possible to increase the contact angle θ of the water droplets W adhering to the main surface (surface) 1*a* and realize lower wettability with respect to water.

In addition, it is preferable that the inorganic member 1 according to the present embodiment is made of glass.

With such a configuration, it is possible to obtain the inorganic member 1 having high translucency and excellent processability.

In addition, in the inorganic member 1 according to the present embodiment, it is preferable that the mean width RSm of roughness profile elements of the fine irregularities 2 is 30 nm or more and 750 nm or less.

Thus, by configuring the range of the mean width RSm of roughness profile elements as described above, it is possible to more easily form the fine irregularities 2 and further, prevent the water droplets W adhering to the main surface (surface) 1*a* of the inorganic member 1 from entering the concave portions 21 of the fine irregularities 2 and decreasing the contact angle θ.

In addition, in the inorganic member 1 according to the present embodiment, it is preferable that the ratio (Rc/RSm) of the mean height Rc of roughness profile elements to the mean width RSm of roughness profile elements s of the fine irregularities 2 is 0.02 or more and 1.00 or less.

Thus, by configuring the range of the ratio (Rc/RSm) of the mean height Rc of roughness profile elements to the mean width RSm of roughness profile elements, which is the virtual aspect ratio of the fine irregularities 2, as described above, it is possible to suppress the height of the convex portions in the uneven shape of the fine irregularities 2, suppress damage due to abrasion or the like, improve durability of the fine irregularities 2, and prevent a decrease in the contact angle of the water droplets W adhering to the main surface (surface) 1*a* of the inorganic member 1 over a long period of time.

In addition, in the inorganic member 1 according to the present embodiment, it is preferable that the arithmetical mean height Sa of the fine irregularities 2 is 1 nm or more and 100 nm or less.

Thus, by configuring the range of the arithmetical mean height Sa as described above, it is possible to more effectively maintain the air layer Q in the concave portions 21 of the fine irregularities 2, and when compared with a smooth plane not having the fine irregularities 2, it is possible to more reliably increase the contact angle θ of the water droplets W adhering to the main surface (surface) 1*a* of the inorganic member 1 and realize lower wettability with respect to water.

In addition, scattering of light due to the uneven shape of the fine irregularities 2 can be minimized and transparency of the main surface (surface) 1*a* of the inorganic member 1 on which the fine irregularities 2 are formed can be more reliably ensured.

In addition, in the inorganic member 1 according to the present embodiment, it is preferable that the maximum height Sz of the fine irregularities 2 is 30 nm or more and 500 nm or less.

Thus, by configuring the range of the maximum height Sz as described above, it is possible to further effectively maintain the air layer Q in the concave portions 21 of the fine irregularities 2, and when compared with a smooth plane not having the fine irregularities 2, it is possible to more reliably increase the contact angle θ of the water droplets W adhering to the main surface (surface) 1*a* of the inorganic member 1 and realize lower wettability with respect to water.

In addition, scattering of light due to the uneven shape of the fine irregularities 2 can be further reliably minimized and transparency of the main surface (surface) 1*a* of the inorganic member 1 on which the fine irregularities 2 are formed can be more reliably ensured.

Further, the inorganic member 1 according to the present embodiment may be characterized by having the fine irregularities 2 on at least a part of the main surface 1*a* (surface) of the inorganic member 1, and without having the above-described characteristics, at least the ratio (Rc/RSm) of the mean height Rc of roughness profile elements to the mean width RSm of roughness profile elements of the fine irregularities 2 is 0.02 or more and 1.00 or less.

As long as the inorganic member 1 has such a configuration, it is at least possible to improve durability of the fine irregularities 2 formed on the main surface 1*a* (surface) of the inorganic member 1 and prevent a decrease in the contact angle of the water droplets W adhering to the main surface 1*a* over a long period of time.

Also, the method for manufacturing the inorganic member 1 according to the present embodiment is a method for manufacturing any one of the above-described inorganic members 1 characterized by performing the wet blast treatment on at least a part of the main surface (surface) 1*a* of the inorganic member 1 to form the fine irregularities 2.

According to the manufacturing method having such a configuration, it is possible to obtain the inorganic member 1 with the fine irregularities 2 formed on the main surface (surface) 1*a*, in which, when compared with a smooth plane not having the fine irregularities 2, it is possible to increase the contact angle θ of the water droplets W adhering to the main surface (surface) 1*a* of the inorganic member 1 and realize lower wettability with respect to water.

INDUSTRIAL APPLICABILITY

The inorganic member, and the method for manufacturing the inorganic member, according to the present invention can be used as an inorganic member having lower wettability with respect to water in the fields of, for example, window panels of automobiles, railway vehicles, ships, aircraft, and the like, ophthalmic lenses, lenses of imaging devices, and the like.

REFERENCE SIGNS LIST

1 Inorganic member
1*a* Main surface (surface)
2 Fine irregularities
2*a* Roughness profile
RSm Mean width of roughness profile elements
Rc Mean height of roughness profile elements
Sa Arithmetical mean height
Ssk Skewness
Sz Maximum height

The invention claimed is:

1. An inorganic member comprising fine irregularities on at least a part of a surface of the inorganic member, wherein a skewness Ssk of the fine irregularities is −0.1 or less, and wherein a mean width RSm of roughness profile elements of the fine irregularities is 30 nm or more and 750 nm or less.

2. The inorganic member according to claim 1, wherein the inorganic member is made of glass.

3. An inorganic member according to claim 1, wherein an arithmetical mean height Sa of the fine irregularities is 1 nm or more and 100 nm or less.

4. The inorganic member according to claim 1, wherein a maximum height Sz of the fine irregularities is 30 nm or more and 500 nm or less.

5. The inorganic member according to claim 1, wherein a ratio (Rc/RSm) of a mean height Rc of roughness profile elements to the mean width RSm of roughness profile elements of the fine irregularities is 0.02 or more and 1.00 or less.

6. A method for manufacturing the inorganic member according to claim 1, the method comprising performing a wet blast treatment on at least a part of a surface of the inorganic member to form the fine irregularities.

7. An inorganic member comprising fine irregularities on at least a part of a surface of the inorganic member, wherein a skewness Ssk of the fine irregularities is-0.1 or less, and wherein a ratio (Rc/RSm) of a mean height Rc of roughness profile elements to the mean width RSm of roughness profile elements of the fine irregularities is 0.02 or more and 1.00 or less.

8. The inorganic member according to claim 7, wherein the inorganic member is made of glass.

9. The inorganic member according to claim 7, wherein an arithmetical mean height Sa of the fine irregularities is 1 nm or more and 100 nm or less.

10. The inorganic member according to claim 7, wherein a maximum height Sz of the fine irregularities is 30 nm or more and 500 nm or less.

11. A method for manufacturing the inorganic member according to claim 7, the method comprising performing a wet blast treatment on at least a part of a surface of the inorganic member to form the fine irregularities.

12. An inorganic member comprising fine irregularities on at least a part of a surface of the inorganic member, wherein a ratio (Rc/RSm) of a mean height Rc of roughness profile elements to a mean width RSm of roughness profile elements of the fine irregularities is 0.03 or more and 1.00 or less.

13. The inorganic member according to claim 12, wherein a mean width RSm of roughness profile elements of the fine irregularities is 30 nm or more and 750 nm or less.

* * * * *